US006196888B1

(12) United States Patent
Kawamura et al.

(10) Patent No.: US 6,196,888 B1
(45) Date of Patent: Mar. 6, 2001

(54) OUTBOARD MOTOR

(75) Inventors: Hiroshi Kawamura; Mitsuharu Tanaka; Takao Aihara, all of Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/333,566

(22) Filed: Jun. 21, 1999

(30) Foreign Application Priority Data

Jun. 26, 1998 (JP) ..... 10-179474

(51) Int. Cl.[7] ..... B63H 21/38
(52) U.S. Cl. ..... 440/89; 440/75; 440/77
(58) Field of Search ..... 440/88, 89, 77, 440/49, 75; 123/195 P, 195 W

(56) References Cited

U.S. PATENT DOCUMENTS 4,378,219 * 3/1983 Tanaka ..... 440/75
5,937,818 * 8/1999 Kawai et al. ..... 123/198 F
6,027,385 * 3/2000 Katayama et al. ..... 440/89
6,033,274 * 3/2000 Mizuguchi et al. ..... 440/89
6,039,020 * 3/2000 Kawamoto et al. ..... 123/196 R
6,039,618 * 3/2000 Hiraoka et al. ..... 440/89
6,062,928 * 3/2000 Watanabe et al. ..... 440/88

FOREIGN PATENT DOCUMENTS 60-24714 2/1982 (JP) .

* cited by examiner

*Primary Examiner*—Russell D. Stormer
*Assistant Examiner*—Andrew D. Wright
(74) *Attorney, Agent, or Firm*—Skjerven Morrill MacPherson LLP; Alan H. MacPherson; Greg J. Michelson

(57) ABSTRACT

In an outboard motor including a centrifugal clutch system between the engine crankshaft and the drive shaft and including an exhaust pipe that has an outlet which is submerged under water in an operable state of the outboard motor, the exhaust pipe is provided with an exhaust vent which is positioned above water in an operable state of the outboard motor. Thus, when a reverse rotation takes place in the event of unsuccessful engine start, the exhaust vent allows atmospheric air to flow into the exhaust pipe so as to prevent the internal combustion engine from working as a suction pump and introducing water into the engine cylinder through the exhaust pipe.

8 Claims, 2 Drawing Sheets

OUTBOARD MOTOR

TECHNICAL FIELD

The present invention relates to outboard motors (or outboard marine engines) which comprises an internal combustion engine used as a power source for a watercraft. More particularly, the present invention relates to a relatively small outboard motor in that an exhaust pipe outlet is submerged under water in an operable state of the outboard motor and a driving force from the engine is prevented from being transmitted to the propeller during engine start.

BACKGROUND OF THE INVENTION

Outboard motors are often used as a power source for a watercraft such as a boat. In many small-power outboard motors, an exhaust pipe connected to an exhaust port of an internal combustion engine in the outboard motor extends downwardly to such an extent that the outlet opening of the exhaust pipe is submerged beneath the water level in an operable state of the outboard motor. Such configuration can reduce the exhaust noise and/or prevent overheating of the extension case into which the hot exhaust gas is discharged. Although it may be conceived to use an additional pump for lifting up water to cool the exhaust gas, this is often impractical in small-power outboard motors in which power loss resulting from operating the additional pump may be significant and/or there may be little spare room for mounting the pump.

It has been also known in small-power outboard motors to connect the output shaft (or crankshaft) of the internal combustion engine and the propeller via a centrifugal clutch system so that the driving force from the engine is prevented from being transmitted to the propeller when the crankshaft rotation speed is lower than a prescribed value. (See for example Japanese Utility Model Publication (kokoku) No. 60-24714.) This can reduce the necessary starting torque produced from a recoil starter and thereby facilitate the starting of the engine. In such outboard motors, however, a so-called "reverse rotation" of the engine (or crankshaft) tends to take place in the event of failure to successfully start the engine. The reverse rotation lowers the pressure inside the cylinder (or combustion chamber) of the engine, generating a negative exhaust pressure.

Thus, if a reverse rotation of the engine takes place in an outboard motor with the exhaust pipe outlet submerged under water, the engine will work as a suction pump and lift up water. Since the number of reciprocating movements of the piston in a single reverse rotation can be estimated to be fewer than five, if the volume inside the exhaust pipe between the water level and the engine exhaust valve (or exhaust port) is greater than five times of the displacement volume of piston, intrusion of water into the combustion chamber can be prevented. However, it is very difficult to achieve such an exhaust pipe having a sufficient volume in a small outboard motor which has little space to spare.

BRIEF SUMMARY OF THE INVENTION

In view of the above, a primary object of the present invention is to provide an improved outboard motor in that a driving force from the engine is prevented from being transmitted to the propeller during engine start and an exhaust pipe outlet is submerged under water in an operable state of the outboard motor, in which it is ensured that intrusion of water into the engine cylinder is prevented if a reverse rotation takes place as a result of unsuccessful engine start.

A second object of the present invention is to provide such an outboard motor in a simple and cost-effective manner.

According to the present invention, these and other objects can be accomplished by providing an outboard motor for a watercraft, comprising: an internal combustion engine having a crankshaft; a drive shaft extending generally vertically; a propeller shaft extending generally horizontally and carrying a propeller at its one end, the propeller shaft operatively connected to a lower end of the drive shaft; clutch means disposed between the crankshaft and the drive shaft for drivingly connecting the crankshaft to the drive shaft only when crankshaft rotation speed is higher than a prescribed rotation speed; an exhaust pipe having one end connected to an exhaust port of the internal combustion engine and extending generally vertically so that the other end thereof is submerged under water in an operable state of the outboard motor, the exhaust pipe provided with an exhaust vent which is positioned above a water level in an operable state of the outboard motor so that atmospheric air can enter the exhaust pipe through the exhaust vent when a pressure in the exhaust pipe becomes negative. Thus, when a reverse rotation takes place in the event of failure in starting the engine, the atmospheric air flowing into the exhaust pipe through the exhaust vent prevents the internal combustion engine from working as a suction pump, to thereby prevent intrusion of water into the engine cylinder.

In order to ensure that the exhaust vent is positioned above water when starting the engine, it is preferable that the outboard motor further comprises a stern bracket to attach the outboard motor to a transom of the watercraft and the exhaust vent is positioned above a surface of the stern bracket contacting an upper end of the watercraft transom in a state that the outboard motor is attached to the watercraft transom.

Further preferably, the outboard motor comprises an engine cowling for covering the internal combustion engine and the exhaust vent is positioned inside the engine cowling. This can minimize the water entrained with the air and entering the exhaust system through the exhaust vent.

When the engine is operating at low speeds or idling, it is often desirable that an exhaust gas from the internal combustion engine is allowed to be discharged through the exhaust vent to thereby reduce the back pressure of the exhaust gas. In such a case, it will be advantageous, for the purpose of preventing the exhaust gas discharged through the exhaust vent from adversely affecting the engine cowling or the like, if the outboard motor further comprises a cooling fan for cooling the internal combustion engine in such a manner that the exhaust gas discharged from the exhaust vent is carried by an air flow caused by the cooling fan to the outside of the engine cowling.

In a preferred embodiment of the invention, during normal speed operation of the outboard motor the exhaust gas flowing through the exhaust pipe drags outside air into the exhaust pipe through the exhaust vent in accordance with an "ejector effect." Without any additional valve or the like, this can prevent a relatively large amount of exhaust gas generated during normal speed operation of the outboard motor from being discharged through the above-water exhaust vent and causing discomfort to the user on the watercraft. This will be particularly beneficial in such an outboard motor in that the exhaust vent is positioned inside the engine cowling in view of preventing the hot exhaust gas from being discharged into and adversely affecting the engine cowling if utilized.

The present invention will be particularly advantageous in the outboard motors where the clutch means consists of a centrifugal clutch system which can automatically prevent the driving force of the engine from being transmitted to the propeller when the crankshaft rotation speed is lower than a prescribed value such as when starting the engine.

According to a preferred embodiment of the present invention, the outboard motor comprises a subsidiary exhaust pipe connected to the exhaust pipe, the subsidiary exhaust pipe having a first opening aligned with an opening provided to the exhaust pipe and a second opening which is positioned above the water level in an operable state of the outboard motor so as to serve as the exhaust vent. Such configuration can facilitate the adjustment of the orientation and/or size of the exhaust vent. Moreover, the subsidiary exhaust pipe may comprise a plate member having a plurality of holes and disposed transversely in the subsidiary exhaust pipe so that the subsidiary exhaust pipe functions as a muffler.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
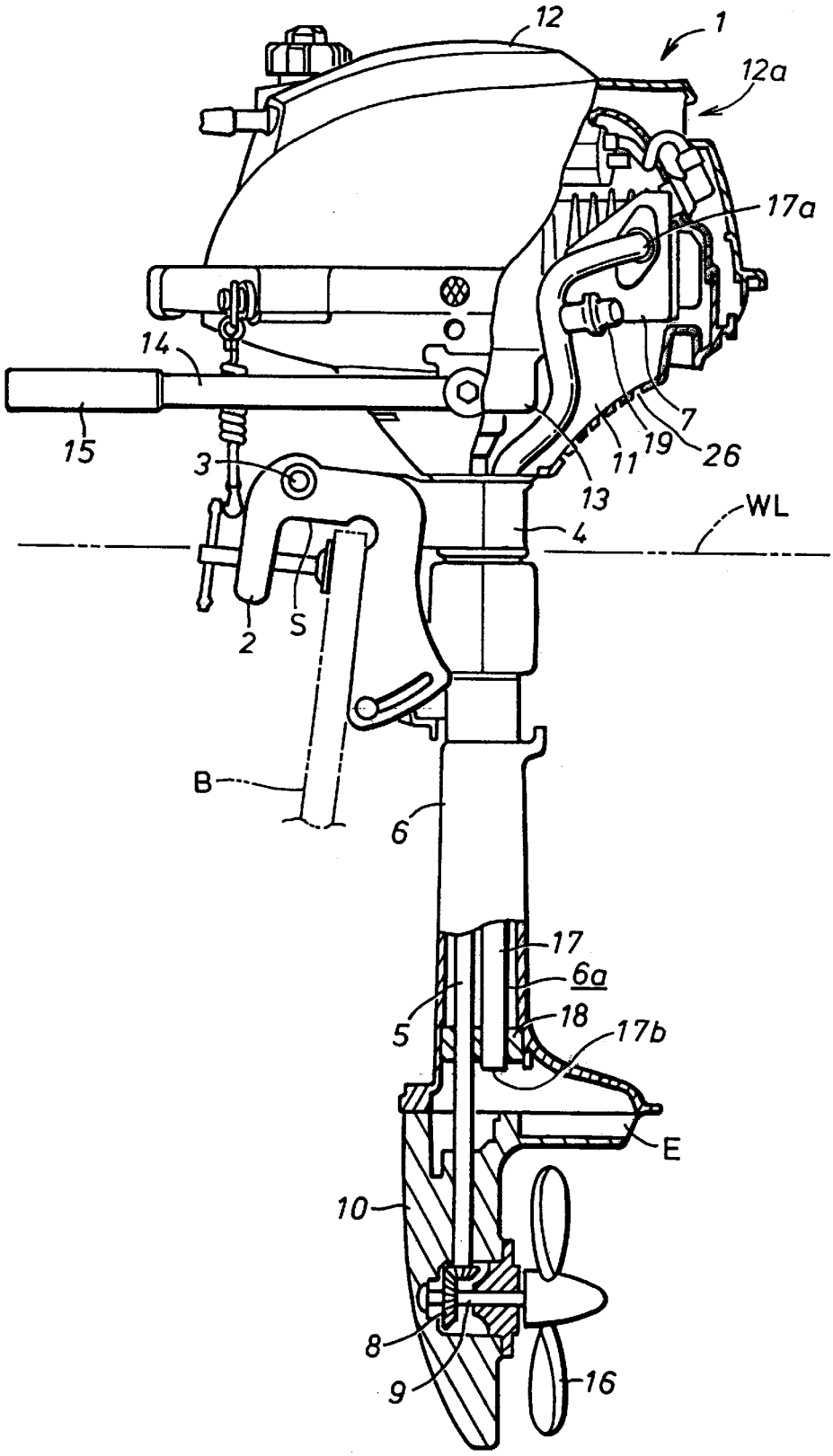
FIG. 1 is a general side view, partially broken away, of an outboard motor to which the present invention is applied.

FIG. 1 generally shows a side view of an outboard motor 1 to which the present invention is applied. The outboard motor 1 is mounted to a transom B of a boat or a watercraft via a stern bracket 2 equipped with clamping means.

To the stern bracket 2 is connected a swivel case 4 so as to be tiltable around a tilt shaft 3 extending laterally and horizontally with respect to the boat. The swivel case 4 supports a substantially cylindrical extension case 6, which accommodates a vertically extending drive shaft 5, in a manner that the extension case 6 can freely swing laterally around a vertical axis for steering the boat.

An internal combustion engine 7 is placed above the extension case 6 and covered by an engine cover 12 and an under case 11 which are detachable from each other. Thus, the engine cover 12 and the under case 11 jointly form an engine cowling. An air intake 12*a* for letting in fresh air for combustion is provided in an upper portion of the engine cover 12.

A gear case 10 is attached to a lower end of the extension case 6, and rotatably supports a propeller shaft 9 connected to the drive shaft 5 via a bevel gear mechanism 8. A screw propeller 16 is attached to the end of the propeller shaft 9.

In the shown embodiment, the engine 7 is an air-cooled, single-cylinder, vertical crankshaft type engine in which the crankshaft is disposed substantially vertically in an operable state of the outboard motor. The lower end of the crankshaft is connected to the drive shaft 5 via a conventional centrifugal clutch system 13.

Although not shown clearly in the drawings, a housing of the centrifugal clutch system 13 is provided with a laterally extending arm that projects out through the under case 11 so that a steering arm 14 can be attached to the arm end. By operating the steering arm 14, a user can swing the outboard motor 1 around the vertical axis of the swivel case 4 to thereby steer the boat. At the free end of the steering arm 14 is provided a throttle grip 15 for controlling a throttle valve of a carburetor and thus controlling the rotation speed of the crankshaft. As the rotation speed of the crankshaft increases as a result of operating the throttle grip 15, when a prescribed rotation speed is reached the centrifugal clutch 13 is engaged so as to allow the crankshaft rotation to be transmitted to the propeller 16 via the drive shaft 5 and the propeller shaft 9.

An exhaust pipe 17 having one end 17*a* connected to an exhaust port of the cylinder block of the engine is adapted so as to extend downwardly within the extension case 6 so that the other end 17*b* of the exhaust pipe 17 is positioned near the lower end of the extension case 6. The exhaust pipe 17 may contain some curved portions in its upper part as shown in FIG. 1 so as to extend in parallel with the drive shaft 5 in the extension case 6. The lower end portion of the exhaust pipe 17 is supported by a circular partition member 18 which is made of a resilient synthetic resin material and fitted in the lower opening of the extension case 6.

Figure 2:
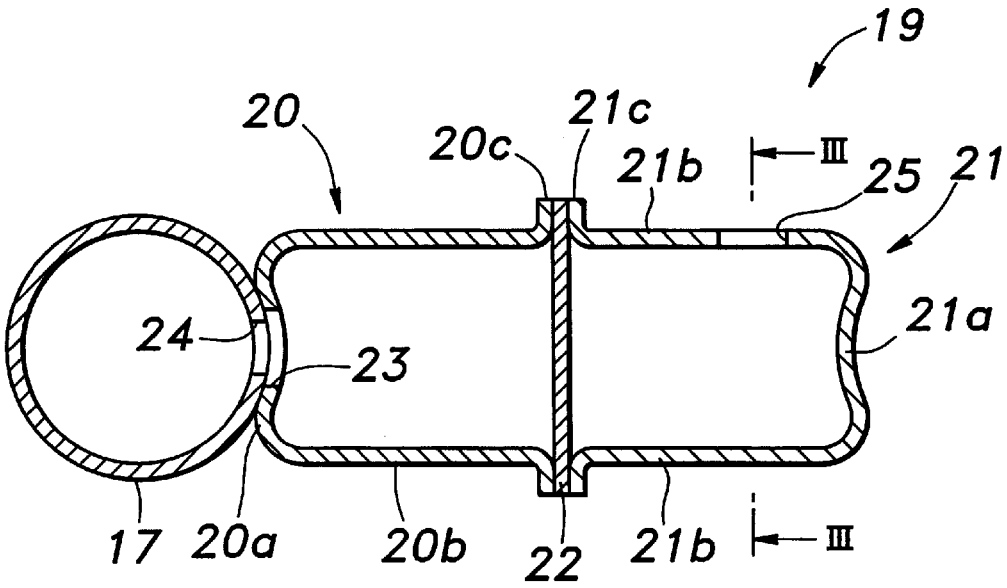
FIG. 2 is a cross sectional view of the subsidiary exhaust pipe 19 taken along its longitudinal axis.
Figure 3:
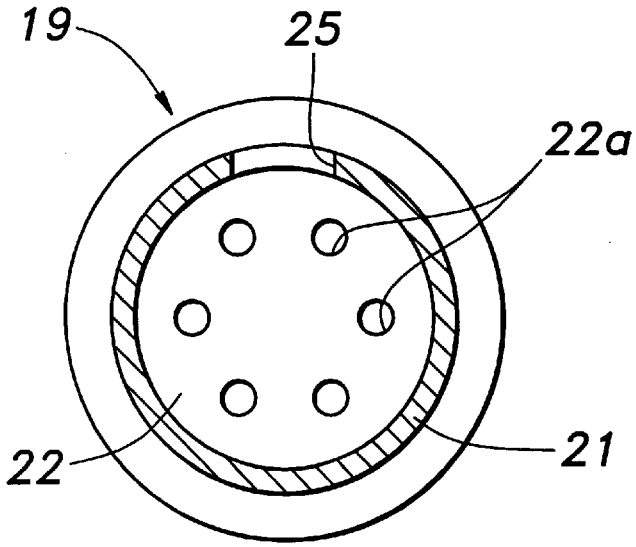
FIG. 3 is a cross sectional view taken along the lines III—III in FIG. 2.

A subsidiary exhaust pipe 19 is connected to a portion of the exhaust pipe 17 near the one end 17*a* sufficiently above the water level and inside the engine cowling. As shown in FIG. 2, this subsidiary exhaust pipe 19 comprises a pair of generally cup-shaped members 20, 21 having bottoms 20*a*, 21*a*, cylindrical side walls 20*b*, 21*b*, and flange portions 20*c*, 21*c*, respectively. The pair of cup-shaped members 20, 21 are arranged so that they open toward each other with a plate or disk member 22 having a plurality of holes 22*a* interposed between them, and in this state these three pieces 20, 21 and 22 are welded together to form a unitary exhaust pipe 19. One cup-shaped member 20 has an opening 23 in its bottom 20*a* and is welded to the outer surface of the exhaust pipe 17 with the opening 23 aligned with an opening 24 provided to the exhaust pipe 17. The other cup-shaped member 21 is provided with an opening or exhaust vent 25 in its cylindrical wall 21*b* such that the exhaust vent 25 preferably faces toward a cylinder head of the engine 7. This exhaust vent 25 is formed so that it is placed at a position higher than a surface S (FIG. 1) of the stern bracket 2 which is in contact with the upper end of the boat transom B in an operable state of the outboard motor 1.

During normal speed operation, the exhaust gas from the engine 7 is discharged from the lower end 17*b* of the exhaust pipe 17 and through an opening E formed at the junction between the extension case 6 and the gear case 10 into water, and then is carried away in a backward direction along with the water flow caused by the propeller rotation. Due to the partition member 18 for sealing the inside space 6*a* of the extension case 6, entrance of the exhaust gas into the extension case 6 is prevented.

If the reverse rotation of the crankshaft takes place as a result of failure in successfully starting the engine using a recoil starter (not shown in the drawings), the pressure inside the exhaust pipe 17 will become somewhat negative. However, according to the present invention the subsidiary exhaust pipe 19 allows atmospheric air to flow into the exhaust pipe 17 through the exhaust vent 25, thus preventing intrusion of water into the engine combustion chamber from the submerged lower end 17*b* of the exhaust pipe 17. It should be noted that when starting the engine, the user has to be near the boat stern which accordingly goes down deeper into water than the stem of the boat. Thus, in order to ensure that the exhaust vent 25 is placed above water during engine start, the exhaust vent 25 is provided at a position higher than a surface S of the stern bracket 2 which is in contact with the upper end of the boat transom B in an operable state of the outboard motor 1 and which substantially corresponds to a possible highest water level WL. It should be also noted that in the shown preferred embodiment, since the subsidiary exhaust pipe 19 (more precisely, the exhaust vent 25) is covered by the engine cowling, the water splash entrained with the air and entering the exhaust system through the subsidiary exhaust pipe 19 is minimized.

At idle engine speed or during low speed engine operation, where the exhaust pressure is low, the subsidiary exhaust pipe 19 functions to discharge the exhaust gas through the exhaust vent 25 so as to reduce the back pressure of the exhaust gas and thus achieve smooth engine rotation. In this case, the exhaust gas discharged from the exhaust vent 25 toward the cylinder head is carried by a cooling air flow generated by a cooling fan (not shown in the drawings but typically mounted over the engine together with the recoil starter as a unit) to the outside through a slit 26 formed in the under case 11. Thus, the hot exhaust gas is prevented from directly impinging on and overheating the under case 11. It should be noted that the subsidiary exhaust pipe 19 consisting of the pair of cup-shaped members 20, 21 and the transversely disposed porous disk member 22 serves as a muffler for reducing the exhaust noise.

It should be also noted that the subsidiary exhaust pipe 19 is adapted so that during normal speed operation where the exhaust gas flow rate through the exhaust pipe 17 is quite high, outside air is dragged into the exhaust pipe 17 through the exhaust vent 25 of the subsidiary exhaust pipe 19 so that it is prevented that a considerable amount of hot exhaust gas is discharged from the exhaust vent 25. Such "ejector effect" can be achieved by suitably selecting the thickness and/or angle of the subsidiary exhaust pipe 19 with respect to the exhaust pipe 17. This can prevent a considerable amount of exhaust gas generated during normal speed operation of the outboard motor from being discharged through the above-water exhaust vent 25 and causing discomfort to the user on the boat. Such a feature is also beneficial in view of preventing the exhaust gas from adversely affecting the engine cowling.

As described above, according to the present invention, if a reverse rotation of the engine takes place as a result of unsuccessful engine start, intrusion of water into the engine combustion chamber can be effectively prevented.

Although the present invention has been described in terms of a preferred embodiment thereof, it will be obvious to a person skilled in the art that various alterations and modifications are possible without departing from the scope of the present invention. For example, the subsidiary exhaust pipe may not be limited to a cylindrical shape but can be square or any other polygonal shape. Further, the clutch means may be a usual manually operated clutch system. Even in such a case, the present invention will be beneficial as long as the clutch system does not operatively connect the crankshaft to the drive shaft at the time when the engine is started. Such modifications should fall within the scope of the present invention defined by the claims.

What we claim is:

1. An outboard motor for a watercraft, comprising:

an internal combustion engine having a crankshaft;

a drive shaft extending generally vertically;

a propeller shaft extending generally horizontally and carrying a propeller at its one end, the propeller shaft operatively connected to a lower end of the drive shaft;

a clutch system disposed between the crankshaft and the drive shaft for drivingly connecting the crankshaft to the drive shaft only when crankshaft rotation speed is higher than a prescribed rotation speed;

an exhaust pipe having one end connected to an exhaust port of the internal combustion engine and extending generally vertically so that the other end thereof is submerged under water in an operable state of the outboard motor, the exhaust pipe provided with an exhaust vent which is positioned above a water level in an operable state of the outboard motor so that atmospheric air can enter the exhaust pipe through the exhaust vent when a pressure in the exhaust pipe becomes negative;

a stern bracket to attach the outboard motor to a transom of the watercraft; and an engine cowling for covering the internal combustion engine, wherein the exhaust vent is positioned inside the engine cowling and above a surface of the stem bracket contacting an upper end of the watercraft transom in a state that the outboard motor is attached to the watercraft transom.

2. An outboard motor according to claim 1, wherein an exhaust gas from the internal combustion engine is allowed to be discharged through the exhaust vent when engine speed is below a prescribed engine speed and the outboard motor further comprises a cooling fan for cooling the internal combustion engine in such a manner that the exhaust gas discharged from the exhaust vent is carried by an air flow caused by the cooling fan to the outside of the engine cowling.

3. An outboard motor according to claim 1, wherein during normal speed operation of the outboard motor the exhaust gas flowing through the exhaust pipe drags outside air into the exhaust pipe through the exhaust vent in accordance with an ejector effect.

4. An outboard motor according to claim 1, wherein the clutch system consists of a centrifugal clutch system.

5. An outboard motor according to claim 1 further comprising a subsidiary exhaust pipe connected to the exhaust pipe, the subsidiary exhaust pipe having a first opening aligned with an opening provided to the exhaust pipe and a second opening which is positioned above the water level in an operable state of the outboard motor so as to serve as the exhaust vent.

6. An outboard motor according to claim 5, wherein the subsidiary exhaust pipe comprises a plate member having a plurality of holes and disposed transversely in the subsidiary exhaust pipe so that the subsidiary exhaust pipe serves as a muffler.

7. An outboard motor according to claim 6, wherein the subsidiary exhaust pipe comprises a pair of generally cup-shaped members opening toward each other with the plate member interposed therebetween, one of said pair of cup-shaped members having an opening in its bottom as the first opening of the subsidiary exhaust pipe and the other of said pair of cup-shaped members having an opening in its cylindrical wall as the second opening of the subsidiary exhaust pipe.

8. An outboard motor according to claim 7, wherein the second opening of the subsidiary exhaust pipe serving as the exhaust vent faces toward a cylinder head of the internal combustion engine, and wherein an exhaust gas from the internal combustion engine is allowed to be discharged through the exhaust vent when engine speed is below a prescribed engine speed and the outboard motor further comprises a cooling fan for cooling the internal combustion engine in such a manner that the exhaust gas discharged from the exhaust vent is carried by an air flow caused by the cooling fan to the outside of the engine cowling.

* * * * *